US009316429B2

(12) United States Patent
Celik et al.

(10) Patent No.: US 9,316,429 B2
(45) Date of Patent: Apr. 19, 2016

(54) COOLING DEVICE COMPRISING A DOOR OPENING MECHANISM

(71) Applicant: Arcelik Anonim Sirketi, Istanbul (TR)

(72) Inventors: Kadir Ridvan Celik, Istanbul (TR); Elif Altay, Istanbul (TR); Haldun Dingec, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 0 days.

(21) Appl. No.: 14/353,277

(22) PCT Filed: Oct. 19, 2012

(86) PCT No.: PCT/EP2012/070772
§ 371 (c)(1),
(2) Date: Apr. 21, 2014

(87) PCT Pub. No.: WO2013/057259
PCT Pub. Date: Apr. 25, 2013

(65) Prior Publication Data

US 2015/0192350 A1 Jul. 9, 2015

(30) Foreign Application Priority Data

Oct. 21, 2011 (TR) ..... A2011 10507

(51) Int. Cl.

| | |
|---|---|
| ***A47B 96/04*** | (2006.01) |
| ***F25D 23/02*** | (2006.01) |
| ***E05B 1/00*** | (2006.01) |
| ***E05B 17/00*** | (2006.01) |
| ***E05B 65/00*** | (2006.01) |

(52) U.S. Cl.
CPC ..... *F25D 23/028* (2013.01); *E05B 1/00* (2013.01); *E05B 1/0015* (2013.01); *E05B 17/0033* (2013.01); *E05B 65/0042* (2013.01); *F25D 23/02* (2013.01); *F25D 2323/021* (2013.01)

(58) Field of Classification Search
CPC ..... F25D 23/028; E05B 83/02
USPC ..... 312/405; 49/276–278; 16/412
See application file for complete search history.

(56) References Cited

U.S. PATENT DOCUMENTS

| | | | | |
|---|---|---|---|---|
| 2,129,923 | A * | 9/1938 | Frankel | F25D 11/02 126/197 |
| 5,908,228 | A * | 6/1999 | Lee | E05B 17/0033 292/251.5 |
| 5,915,805 | A * | 6/1999 | Lee | E05B 17/0033 292/251.5 |
| 8,328,301 | B2 * | 12/2012 | Lee | A47B 95/02 292/336.3 |
| 2003/0090187 | A1 * | 5/2003 | Kawamura | E05B 1/0015 312/401 |
| 2009/0179540 | A1 * | 7/2009 | Seo | E05B 17/0033 312/405 |
| 2009/0261701 | A1 * | 10/2009 | Yun et al. | 312/405 |
| 2009/0273264 | A1 * | 11/2009 | Butler | 312/405 |

(Continued)

FOREIGN PATENT DOCUMENTS

| | | | |
|---|---|---|---|
| DE | 202005008449 | U1 | 9/2006 |
| EP | 1174668 | B1 | 3/2004 |

(Continued)

*Primary Examiner* — Matthew Ing
(74) *Attorney, Agent, or Firm* — Venjuris P.C.

(57) ABSTRACT

A cooling device (1) is described that includes a body (2) wherein the objects to be cooled are placed, two doors (3) providing access into the body (2) and which remain side by side when closed, two door opening mechanisms (4), each situated on one door (3) and wherein the distance between the doors (3) is decreased.

10 Claims, 3 Drawing Sheets

(56) References Cited

U.S. PATENT DOCUMENTS

Figure 1:
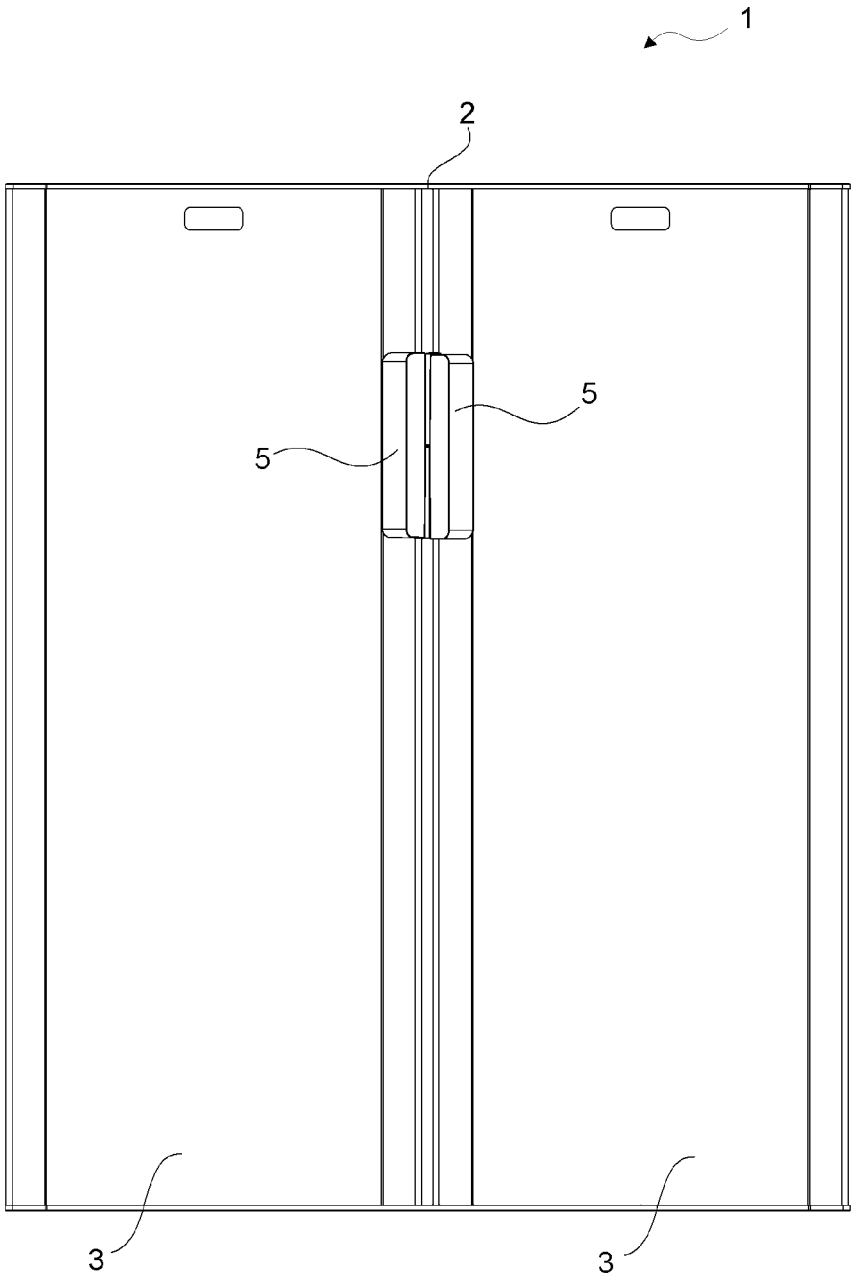

2010/0101267 A1* 4/2010 Jung et al. ..... 62/449
2011/0273070 A1 11/2011 Shin et al.

FOREIGN PATENT DOCUMENTS

EP 2385331 A1 11/2011
JP 7218103 A 8/1995

* cited by examiner

COOLING DEVICE COMPRISING A DOOR OPENING MECHANISM

The present invention relates to a cooling device comprising two side-by-side doors.

In cooling devices, for example in refrigerators, doors, which allow access to the inside of the cooling device and which separate the cooling compartment from the outer environment, are located. The said doors are opened and closed by means of a handle. Sometimes vacuum occurs around the door due to the temperature difference between the interior environment and the outer environment and opening the door by means of the handle becomes difficult. In order to eliminate the said problem, door opening mechanisms are used that provide the door to be easily separated from the body. In the said mechanisms, the handle is rotatably mounted to the edge of a support member whereon a movement mechanism is situated and the support member is secured on the side wall of the door. In cooling devices comprising two side-by-side doors, the portions of the door opening mechanisms that are secured on the side wall of the door overlap and cause a gap to be formed between the two doors. This causes the outer appearance to be distorted and the insulation effectiveness of the interior air to decrease.

In the state of the art Japanese Patent Application No. JP7218103, a cooling device with two side-by-side doors is described. Handles are situated on the edges of the outer surfaces of the doors of the cooling device facing each other and the shapes of the handles are adjusted such that there remains minimum gap between the doors.

In the state of the art European Patent Document No. EP1174668, a door opening mechanism is described, comprising a handle which is mounted on the side wall of the door of the cooling device and which rotates when pulled and thus facilitates the separation of the door from the body. In this embodiment, the door opening mechanism is used in a single-door cooling device.

The aim of the present invention is the realization of a cooling device wherein the distance between the doors is decreased.

The cooling device realized in order to attain the aim of the present invention, explicated in the first claim and the respective claims thereof, comprises two doors secured on the body from one side and that remain side by side when closed and two door opening mechanisms, each extending from the side wall of one door facing each other towards the front surfaces. The door opening mechanism comprises a handle that extends outwards from the front surface of the door, at least one support member that is secured on the side wall of the door and onto one edge of which the handle is rotatably secured and a latch situated on the support member and which facilitates the opening of the door by moving from the door towards the body by means of a movement mechanism situated between the handle and the latch when the handle moves.

In the cooling device of the present invention, the handles on the doors are at the same height, and the support members that are secured on the side wall of the door are positioned at different heights. In this embodiment, the support members are situated so as to be one over the other. Thus, the support members do not come opposite to each other and the gap between the doors is reduced. This provides the cold air in the interior environment to be effectively preserved.

In an embodiment of the present invention, the handles rotate around the axis which is perpendicular to the floor whereon the cooling device is placed. In this embodiment, the handles are longitudinally positioned so as to be parallel to the door. When rotated by the user, the handle sweeps a small part outward and thus ease of use is provided.

In another embodiment of the present invention, the handles rotate around the axis which is parallel to the floor whereon the cooling device is placed. Thus, the force arm is extended and the force required for rotating the handle is reduced.

In another embodiment of the present invention, the handles rotate in opposite directions. Thus, the handles are prevented from impacting one another during the opening of the door.

In another embodiment of the present invention, the distance between the two doors is less than the total thickness of the support members. Thus, the insulation in the inner volume of the cooling device is provided to be improved.

In another embodiment of the present invention, the door opening mechanisms mounted on the doors are same and the support members are placed reverse-symmetrically so as not to overlap each other. Thus same component can be used in both doors and hence the production and storage costs decrease.

In another embodiment of the present invention, the movement mechanism comprises a cam shaft which provides the handle to be rotatably secured to the support member and a transmission member that transmits the movement of the shaft to the latch. The protrusion-shaped portion of the cam shaft that rotates together with the handle pushes the transmission member that is preferably rod-shaped. The transmission member, the other end of which contacts the latch, transmits the movement delivered from the cam shaft to the latch and thus provides the latch to move. Thus, the rotational movement of the handle is transmitted to the latch by being converted to linear movement and the latch facilitates the separation of the door from the body by moving from the door towards the body.

By means of the present invention, the distance between the doors of the cooling device that comprises two side-by-side doors is decreased. Thus both the outer appearance of the cooling device is improved and energy consumption is decreased by increasing the insulation effectiveness.

The cooling device realized in order to attain the aim of the present invention is illustrated in the attached figures, where:

FIG. 1—is the front view of the cooling device of the present invention.

Figure 2:
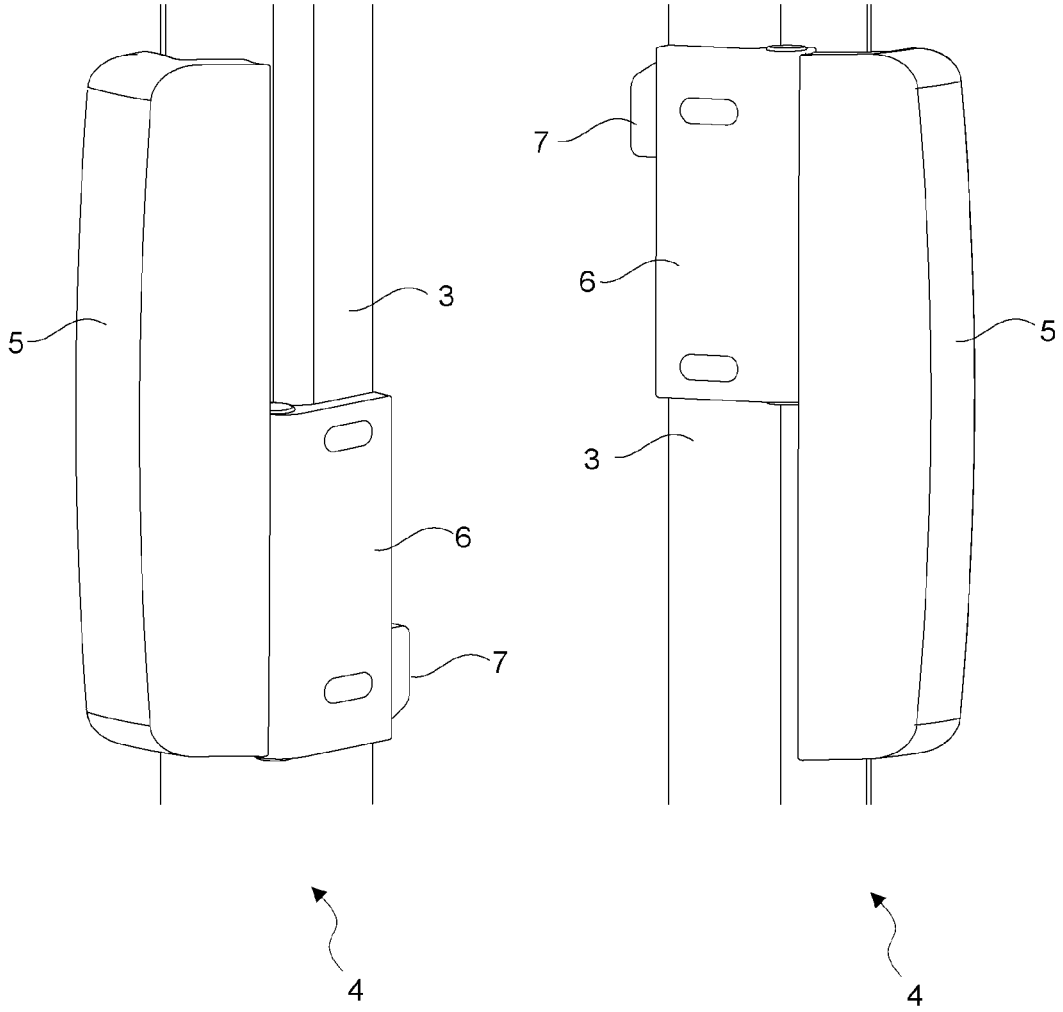

FIG. 2—is the perspective view of the door opening mechanisms.

Figure 3:
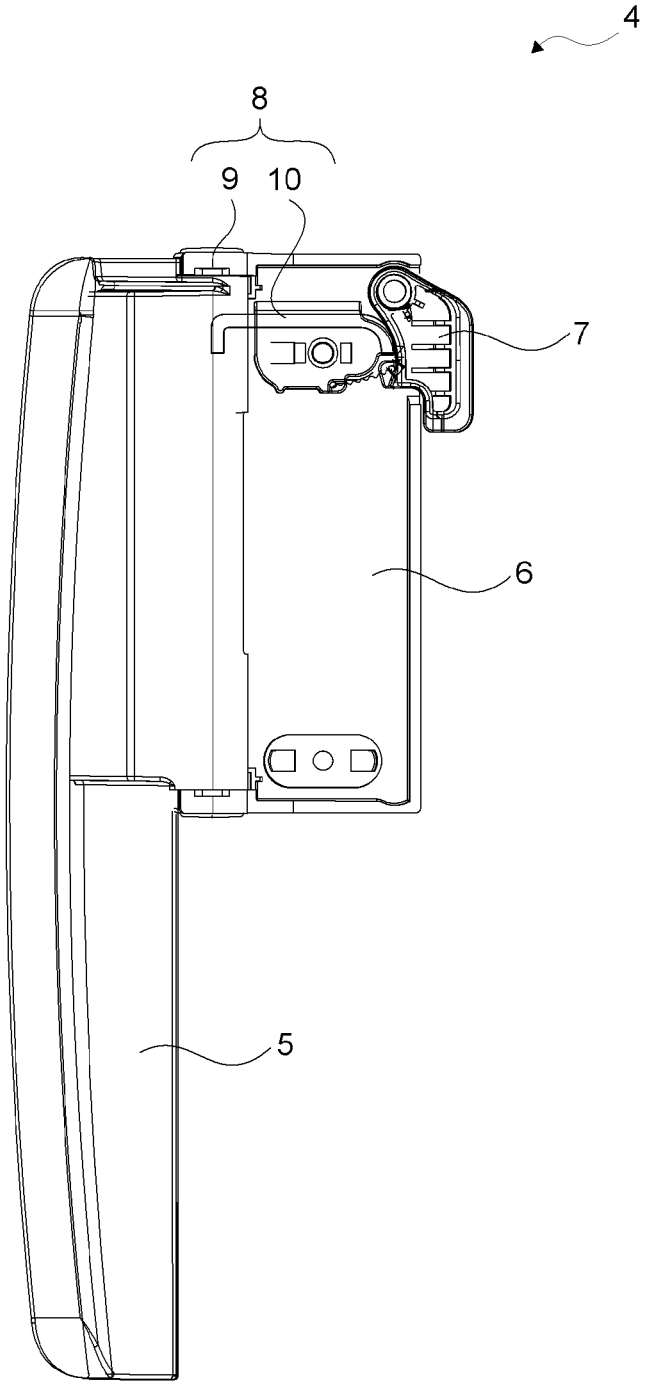

FIG. 3—is the sideways view of the door opening mechanism.

The elements illustrated in the figures are numbered as follows:

1. Cooling device
2. Body
3. Door
4. Door opening mechanism
5. Handle
6. Support member
7. Latch
8. Movement mechanism
9. Cam shaft
10. Transmission member The cooling device (1) comprises a body (2) wherein the objects to be cooled are placed, two doors (3) providing access into the body (2) and which remain side by side when closed and one door opening mechanism (4) situated on each door (3) (FIG. 1).

The door opening mechanism (4) comprises a handle (5) that provides the door (3) to be opened by being moved by the user, at least one support member (6) that is secured on the side walls of the doors (3) facing each other and to one edge of which the handle (5) is rotatably mounted, a latch (7) situated on the support member (6) and which provides the door (3) to be separated from the body (2) by being actuated by the movement of the handle (5) and a movement mechanism (8) that transmits the movement of the handle (5) to the latch (7).

When the door (3) is in the closed position, the handle (5) makes rotational movement when pulled. The rotational movement of the handle (5) is converted to linear movement and transmitted to the latch (7) by the movement mechanism (8), and the latch (7) is provided to be pushed from the door (3) through the body (2). By means of the movement of the latch (7), the vacuum effect inside the cooling device (1) is eliminated and the door (3) is provided to be easily opened. When the handle (5) is released, the handle (5) and the latch (7) resume their first positions by means of the springs included in the movement mechanism (8) (FIG. 1, FIG. 2).

The cooling device (1) of the present invention comprises support members (6) which are assembled on the doors (3) such that the handles (5) are at the same level in the vertical direction and which do not overlap each other in the vertical direction. When the cooling device (1) is viewed from the outside, the handles (5) appear side by side and at the same height but the gap between the doors (3) is reduced since the support members (6) are at different heights. This improves the esthetic appearance and provides the air inside the body (2) to be insulated more effectively.

In an embodiment of the present invention, the handle (5) rotates around the axis which is parallel to the longer edge of the door (3). In this embodiment, the handles (5) extend on the door (3) in the vertical direction and when pulled, the volume opening to the outside from the door (3) surface is minimized. This provides ease of utilization. Moreover, both handles (5) can be held at the same level.

In another embodiment of the present invention, the handle (5) rotates around the axis which is parallel to the shorter edge of the door (3). In this embodiment, since the force arm is long, a little force is sufficient for rotating the handle (5). This provides ease of utilization.

In another embodiment of the present invention, the handles (5) rotate in opposite directions according to each other. Thus the handles (5) are prevented from impacting one another during the opening of the door (3).

In another embodiment of the present invention, the distance between the side walls of the doors (3) facing each other is less than the total thickness of the support members (6). Thus the air inside the cooling device (1) is provided to be effectively preserved.

In another embodiment of the present invention, the door opening mechanisms (4) are identical and reverse-symmetrically placed on the doors (3). Thus ease of production and ease of storage are provided and cost advantage is gained (FIG. 2).

In another embodiment of the present invention, the movement mechanism (8) comprises a cam shaft (9) which is borne on the support member (6) and which provides the handle (5) to rotate and a transmission member (10) which is situated between the cam shaft (9) and the latch (7) and which transmits the movement of the cam shaft (9) to the latch (7). Thus, even though the handle (5) rotates with a very small angle, the movement is easily transmitted to the latch (7). In this embodiment, the movement mechanism (8) and the latch (7) are situated on the inner surface of the support member (6) and are not seen by the user. This improves the esthetic appearance (FIG. 3).

By means of the present invention, the gap between the doors (3) of a double door cooling device (1) is reduced. Thus both the outer appearance is improved and the air inside the cooling device (1) is provided to be effectively preserved.

It is to be understood that the present invention is not limited to the embodiments disclosed above and a person skilled in the art can easily introduce different embodiments. These should be considered within the scope of the protection postulated by the claims of the present invention.

The invention claimed is:

1. A cooling device (1) comprising a body (2) wherein the objects to be cooled are placed, two doors (3) providing access into the body (2) and which remain side by side when closed and one door opening mechanism (4) situated on each door (3) having a handle (5) that provides the door (3) to be opened by being moved, at least one support member (6) that is secured on a side wall of each door (3) wherein the side wall of each door are facing each other and to one edge of which the handle (5) is rotatably mounted, a latch (7) situated on the support member (6) and which provides the door (3) to be separated from the body (2) by being actuated by the movement of the handle (5) and a movement mechanism (8) that transmits the movement of the handle (5) to the latch (7), wherein the support members (6) which are assembled on on each door (3) such that the handle of each door is (5) at the same level in the vertical direction and the handle of each door does not overlap in the vertical direction; wherein the distance between the side walls facing each other is less than the total thickness of the support members.

2. A cooling device (1) as in claim 1, characterized by the handle (5) that rotates around the axis which is parallel to the longer edge of the door (3).

3. A cooling device (1) as in claim 2, characterized by the handle of each door (5) rotates in opposite directions to each other.

4. A cooling device (1) as in claim 3, characterized by the door opening mechanisms (4) that are identical and placed reverse-symmetrically on the doors (3).

5. A cooling device (1) as in claim 4, characterized by the movement mechanism (8) that comprises a cam shaft (9) which is borne on the support member (6) and which provides the handle (5) of each door to rotate and a transmission member (10) which is situated between the cam shaft (9) and the latch (7) and which transmits the movement of the cam shaft (9) to the latch (7).

6. A cooling device (1) as in claim 1, characterized by the door opening mechanisms (4) that are identical and placed reverse-symmetrically on the doors (3).

7. A cooling device (1) as in claim 1, characterized by the movement mechanism (8) that comprises a cam shaft (9) which is borne on the support member (6) and which provides the handle (5) of each door to rotate and a transmission member (10) which is situated between the cam shaft (9) and the latch (7) and which transmits the movement of the cam shaft (9) to the latch (7).

8. A cooling device (1) as in claim 1, characterized by the handle of each door (5) rotates in opposite directions to each other.

9. A cooling device (1) as in claim 8, characterized by the door opening mechanisms (4) that are identical and placed reverse-symmetrically on the doors (3).

10. A cooling device (1) as in claim 9, characterized by the movement mechanism (8) that comprises a cam shaft (9) which is borne on the support member (6) and which provides the handle (5) of each door to rotate and a transmission member (10) which is situated between the cam shaft (9) and the latch (7) and which transmits the movement of the cam shaft (9) to the latch (7).

* * * * *